US007278832B2

(12) United States Patent
Lifson et al.

(10) Patent No.: US 7,278,832 B2
(45) Date of Patent: Oct. 9, 2007

(54) SCROLL COMPRESSOR WITH ENLARGED VAPOR INJECTION PORT AREA

(75) Inventors: Alexander Lifson, Manlius, NY (US); James William Bush, Skaneateles, NY (US)

(73) Assignee: Carrier Corporation, Syracuse, NY (US)

( * ) Notice: Subject to any disclaimer, the term of this patent is extended or adjusted under 35 U.S.C. 154(b) by 282 days.

(21) Appl. No.: 10/752,757

(22) Filed: Jan. 7, 2004

(65) Prior Publication Data

US 2005/0147514 A1 Jul. 7, 2005

(51) Int. Cl.
*F04B 49/00* (2006.01)

(52) U.S. Cl. ..... 417/310; 417/440; 418/15; 418/55.1; 418/55.5; 418/57

(58) Field of Classification Search ..... 418/55.1–55.6, 418/57, 15; 417/310, 440; 62/505, 510
See application file for complete search history.

(56) References Cited

U.S. PATENT DOCUMENTS 5,103,652 A * 4/1992 Mizuno et al. ..... 418/55.6
5,855,475 A * 1/1999 Fujio et al. ..... 418/55.1
5,996,364 A * 12/1999 Lifson et al. ..... 62/196.1
6,042,344 A * 3/2000 Lifson ..... 417/310
6,142,753 A * 11/2000 Bush et al. ..... 418/55.1
6,619,936 B2 9/2003 Perevozchikov
7,100,386 B2 * 9/2006 Lifson ..... 418/55.2

FOREIGN PATENT DOCUMENTS

JP 03081588 A * 4/1991
JP 2000161263 A * 6/2000

* cited by examiner

*Primary Examiner*—Theresa Trieu
(74) *Attorney, Agent, or Firm*—Carlson, Gaskey & Olds

(57) ABSTRACT

Scroll compressors are provided with vapor injection or by-pass ports that will allow greater flow of refrigerant through the port than was the case in the prior art. The prior art has typically utilized a single injection port having a diameter equal to or slightly larger than the thickness of the scroll wrap. In this way, the scroll wrap is able to prevent or restrict cross-flow leakage from the port from passing between the two compression chambers. However, this single port has also limited the amount of refrigerant that can be returned. In one embodiment, the present invention utilizes a plurality of ports generally spaced along the length of the wrap such that cross-flow can still be prevented while providing a greater cross-sectional flow area into or out of the compression chambers. In another embodiment, the several ports may be replaced by a single elongated port. Further, if cross-flow leakage is not a particular problem, the ports may be positioned such that they begin to communicate, and stop communicating, serially, with the two chambers.

11 Claims, 3 Drawing Sheets

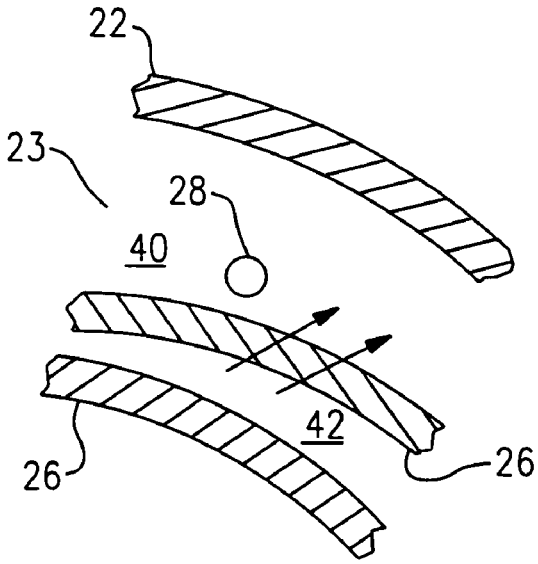
FIG.2A
Prior Art
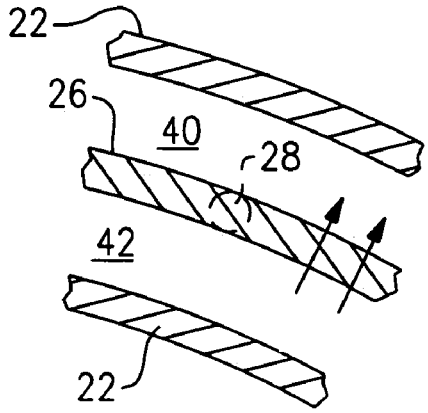
FIG.2B
Prior Art
FIG.2C
Prior Art
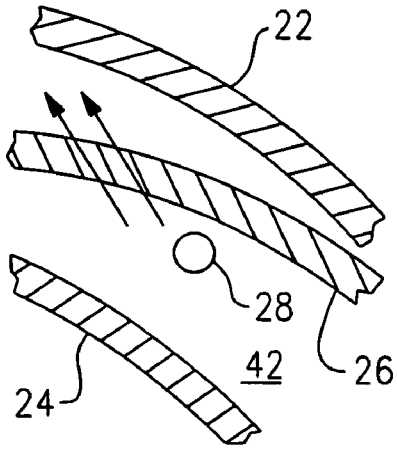

SCROLL COMPRESSOR WITH ENLARGED VAPOR INJECTION PORT AREA

BACKGROUND OF THE INVENTION

This application relates to a scroll compressor wherein the flow of returned economized fluid into the compression chambers occurs through greater port area than has been the case in the prior art.

Scroll compressors are becoming widely utilized in refrigerant compression applications. As known, in a scroll compressor, two scroll members each have a base and a generally spiral wrap extending from the base. The wraps interfit to define a pair of compression chambers. One of the two scroll members is caused to orbit relative to the other, and as the scroll member orbits, the size of the compression chambers reduces, compressing an entrapped refrigerant.

One feature that is becoming more common in refrigerant cycles is the use of an economizer cycle. In an economizer cycle, a refrigerant is tapped downstream of a heat exchanger, and caused to flow through a separate economizer expansion device, and then through an economizer heat exchanger. In the economizer heat exchanger, this tapped refrigerant subcools a main refrigerant flow, providing a greater cooling capacity from the main refrigerant flow.

The refrigerant from the tap is returned to the compressor at an intermediate compression point. In scroll compressors, it is often the case that this returned economizer flow flows through the base of the fixed or orbiting scroll, and into the compression chambers.

Known scroll compressors have typically utilized two injection ports returning the refrigerant into the pair of chambers with one of each of the ports communicating with one of each of the pair of chambers exclusively. However, some known compressors have utilized a single port which communicates alternately between each of the pair of chambers as the tip of the wrap of the mating scroll moves over it. The size of a single port has generally been limited in cross-sectional area to prevent the flow of refrigerant from one of the chambers to the other through the port. That is, it has been seen as desirable to the scroll compressor designer that this port have a diameter that is at most only slightly larger than the width of the scroll wrap, such that the scroll wrap will prevent the flow from one of the chambers to the other as the wrap moves over the port. Known scroll compressors have used a single port whose diameter is up to about 1.5 times the width of the scroll wrap. This has limited the cross-sectional area of the hole, and limited the amount of refrigerant that can be returned through the economizer injection port.

SUMMARY OF THE INVENTION

In a disclosed embodiment of this invention, a scroll compressor is provided with an economizer injection port that generally can be covered by a wrap moving along a base that receives the port, but wherein the cross-sectional area of the port is greater than a circle having an area defined by a diameter equal to or slightly larger than the width of the wrap. Stated another way, the injection port can be substantially covered by the wrap, but there is an additional port cross-sectional area extending along the wrap such that the wrap will still cover the port. In one embodiment, the additional area is provided by several ports, while in another embodiment, a port is elongated along the length of the wrap. Either embodiment provides the benefit of preventing cross-chamber flow, while still providing greater cross-sectional area flow into the compressor.

In yet another embodiment, wherein cross-chamber flow is not a concern, there may be a pair of ports that will not both be covered by the wrap.

These and other features of the present invention can be best understood from the following specification and drawings, the following of which is a brief description.

BRIEF DESCRIPTION OF THE DRAWINGS

FIG. 2A shows a prior art scroll wrap in a first position.

FIG. 2B shows a subsequent position.

FIG. 2C shows yet another position.

DETAILED DESCRIPTION OF THE PREFERRED EMBODIMENT

Figure 1:
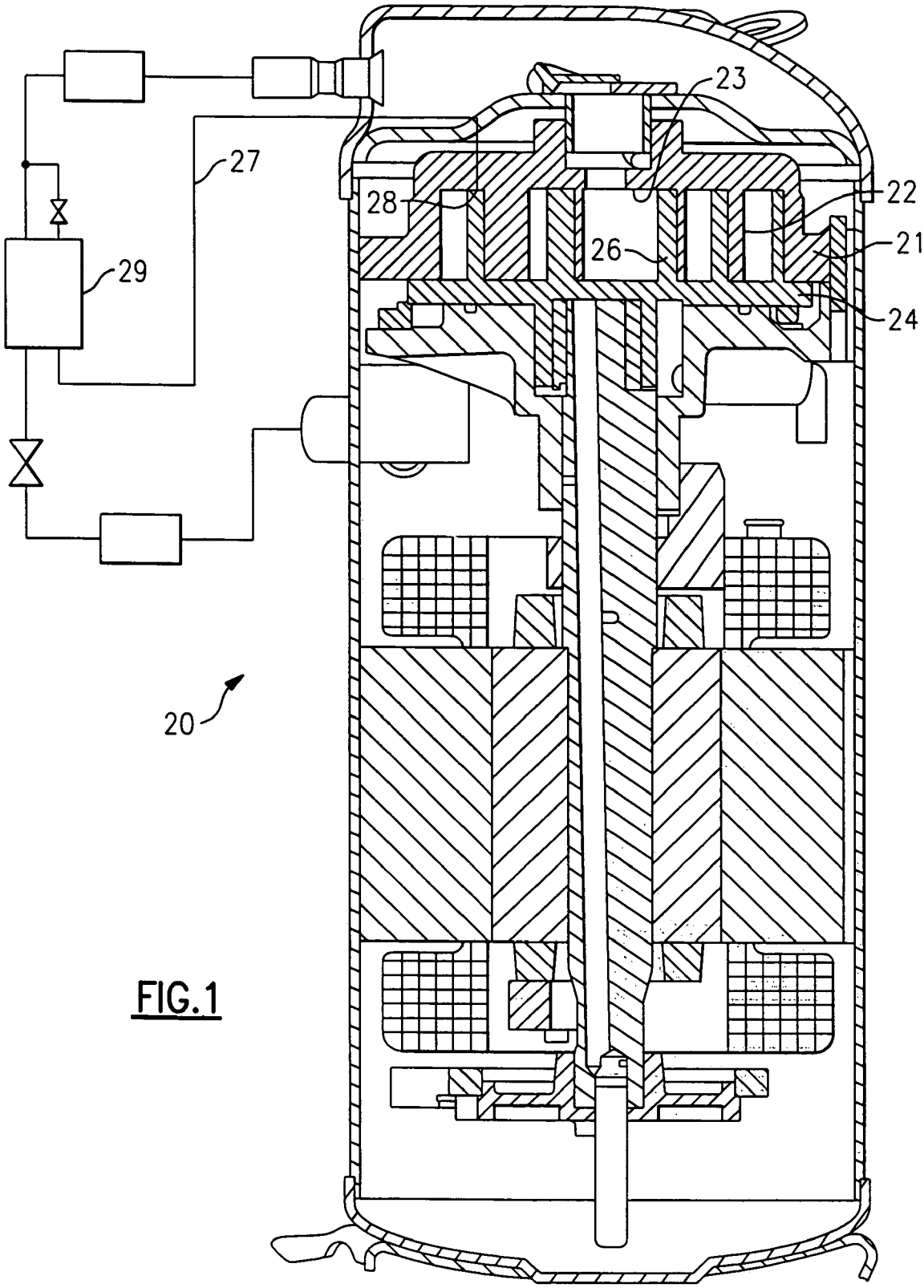
FIG. 1 is a cross-sectional view showing a scroll compressor.

As shown in FIG. 1, a scroll compressor 20 generally incorporates a fixed scroll 21 having a base 23, and a wrap 22. An orbiting scroll 24 carries its own wrap 26. As shown, an injection port 28 communicates with a return line 27, from an economizer heat exchanger 29 to return a refrigerant into the scroll compressor.

As shown in FIG. 2A, the orbiting scroll wrap 26 moves along the base 23. A compression chamber 40 is defined outwardly of the wrap 26, and another chamber 42 is defined at an opposed face of the wrap 26. As can be appreciated, if economized operation is ongoing at the point shown in FIG. 2A, refrigerant will flow from the port 28 into the chamber 40. As the wrap 26 continues to move, eventually the wrap covers the port 28, see FIG. 2B. There has been a limitation in the prior art in that at the point the wrap covers the port 28, scroll compressor designers have desired that there be little or no cross-flow from chamber 40 into chamber 42. Thus, the thickness of the wrap 26 at the point shown in FIG. 2B has limited the size of the port 28.

As shown in FIG. 2C, subsequent to the FIG. 2B position, the wrap was moved to uncover the port 28, and the port 28 can deliver refrigerant into the chamber 42.

Figure 3A:
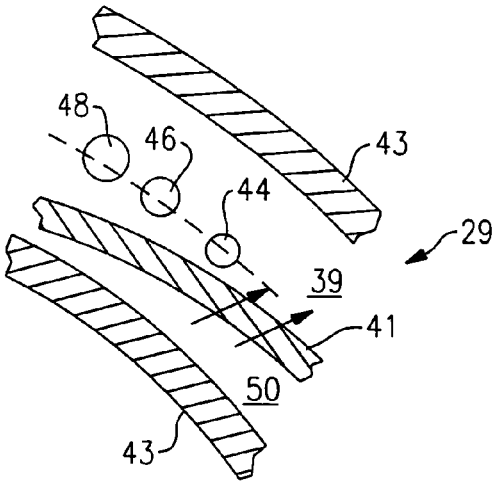
FIG. 3A shows a first inventive embodiment.

FIG. 3A shows a first embodiment 29. In embodiment 29, the fixed scroll wraps 43 and the orbiting scroll wrap 41 may be similar to the FIG. 2A-2C embodiment. However, the chambers 39 and 50 are associated with several injection ports 44, 46 and 48. As shown, if the wrap 41 changes in width along its length, the ports 44, 46 and 48 may also change in size. It should be understood that so-called "hybrid" wrap scroll compressors have a varying thickness scroll wrap along its length. Since several ports 44, 46 and 48 are utilized, greater volume of refrigerant can be injected into the compression chambers 39 and 50.

Figure 3B:
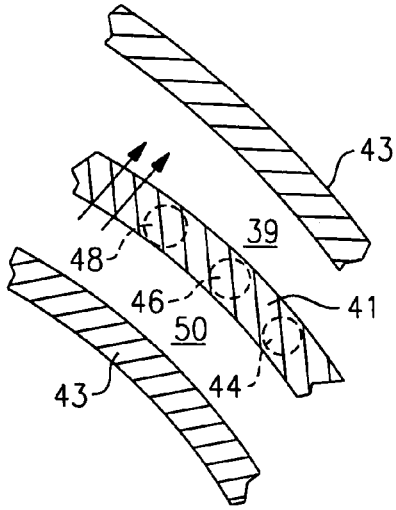
FIG. 3B shows the FIG. 3A embodiment subsequent to the FIG. 3A position.
Figure 4:
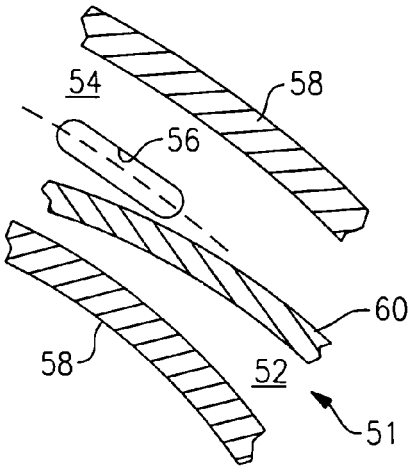
FIG. 4 shows another embodiment.

As shown in FIG. 3B, the wrap 41 is still able to close off flow from the ports 44, 46 and 48 as it passes. But, a greater volume of refrigerant can be injected relative to a single port design FIG. 4 shows yet another embodiment 51, wherein the chambers 52 and 54 are positioned on opposed sides of the orbiting scroll wrap 60, which is moving between the fixed scroll wrap 58. The port 56 is elongated, such that it has a greater dimension along the length of the wrap 60, and such that refrigerant will not flow between the chambers 52 and 54 through the port 56, yet a greater volume of refrigerant can be injected through the port 56 than was the case in the prior art FIG. 2A-2C.

Figure 5:
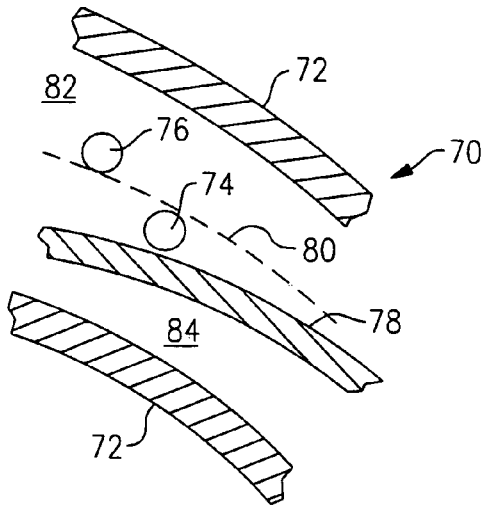
FIG. 5 shows yet another embodiment.

FIG. 5 shows yet another embodiment 70, wherein the cross-flow issue described above is of less concern. In embodiment 70, the orbiting scroll wrap 78 moves between the non-orbiting scroll wrap 72. A pair of ports 74 and 76 are positioned to inject the returned refrigerant vapor. However, as the wrap 78 passes over the ports 74 and 76, there is a period of time such as shown in phantom at 80, wherein the port 76 may still be delivering refrigerant into a chamber 82, while the port 74 may now be delivering refrigerant into the chamber 84.

The multiple injection ports or an elongated port configuration described above can also be used for bypass unloading operation, where partially compressed refrigerant is returned back to suction through the port or port. In this case, the bypass unloading operation can be done in conjunction with the ability to do economized operation, or the bypass unloading can be performed separately without having the economized circuit present. In the case of by-pass operation, multiple ports or an elongated port allows for larger amounts of refrigerant to be by-passed into the compressor suction from the intermediate compression chambers than would be possible with a single small port. This increases the amount of unloading, thus increasing the compressor operating range, which in turn increases system operating efficiency and reduces compressor cycling.

While the present invention illustrates the port in the base of the non-orbiting scroll, it should be understood that the port could be formed in the base of the orbiting scroll with the wrap of the non-orbiting scroll controlling or blocking flow through the port.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from its base, said wraps of said first and second scroll members interfitting to define compression chambers, with a first compression chamber being defined on one side of said second scroll wrap and a second compression chamber being defined at an opposed face, said second scroll member being caused to orbit relative to said first scroll member to change a size of said compression chambers;

an injection port for injecting a refrigerant from an economizer cycle back into said compression chambers and for bypassing refrigerant out of said compression chambers, said injection port extending through said base of one of said first and second scroll members, said injection port having a cross-sectional area that is defined by a form other than a single opening which comprises a circle of constant diameter; and wherein during an orbiting cycle said second scroll member having its wrap initially on one side of said injection port, such that said injection port communicates with said first compression chamber, said wrap then moving over and blocking said injection port, and then moving past said injection port such that said injection port now communicates with said second compression chamber.

2. The scroll compressor as set forth in claim 1, wherein there are a plurality of openings defining said injection port, said plurality of openings being spaced along a length of said wrap of other of said first and second scroll members at said location.

3. The scroll compressor as set forth in claim 2, wherein said plurality of openings are sized and positioned such that said wrap of the other of said first and second scroll members prevents cross-flow between said inner and outer compression chambers through said openings.

4. The scroll compressor as set forth in claim 1, wherein said injection port is elongated, with a greater dimension along a length of said wrap that will move over said port than a thickness of said port, such that when said wrap of the other of said first and second scroll members moves over said elongated port, said wrap will still block flow from said first compression chamber into said second compression chamber from said port.

5. The scroll compressor as set forth in claim 1, wherein said injection port includes a plurality of separate injection port openings, with said openings being positioned and sized such that a first of said openings will close and stop delivering refrigerant into one of said compression chambers, while a second of said injection ports is still delivering refrigerant into said one of said compression chambers, and said first injection port will begin delivering refrigerant into the other of said compression chambers before said second injection port begins to deliver refrigerant into said other of said compression chambers.

6. The scroll compressor set forth in claim 1, wherein said one of said first and second scroll members is said first scroll member.

7. A scroll compressor comprising:

a first scroll member having a base and a generally spiral wrap extending from said base;

a second scroll member having a base and a generally spiral wrap extending from its base, said wraps of said first and second scroll members interfitting to define compression chambers, with a first compression chamber being defined on one side of said second scroll wrap and a second compression chamber being defined at an opposed face, said second scroll member being caused to orbit relative to said first scroll member to change a size of said compression chambers;

a plurality of injection port openings for injecting a refrigerant from an economized cycle back into said compression chambers and for bypassing refrigerant out of said compression chambers, said injection port openings extending through said base of one of said first and second scroll members, and;

each of said injection ports being positioned such that each of said ports communicates alternately between said first compression chamber and said second compression chamber as a result of said wrap of the other of said first and second scroll members passing over each of said ports.

8. The scroll compressor as set forth in claim 7, wherein said plurality of openings are sized and positioned such that said wrap of the other of said first and second scroll members prevents cross-flow between said inner and outer compression chambers through said openings.

9. The scroll compressor as set forth in claim 7, wherein said plurality of injection port openings are positioned and sized such that a first of said openings will close and stop delivering refrigerant into one of said compression chambers, while a second of said injection ports is still delivering refrigerant into said one of said compression chambers, and said first injection port will begin delivering refrigerant into the other of said compression chambers before said second injection port begins to deliver refrigerant into said other of said compression chambers.

10. The scroll compressor set forth in claim 7, wherein said one of said first and second scroll members is said first scroll member.

11. The scroll compressor as set forth in claim 7, wherein during an orbiting cycle said second scroll member having its wrap initially on one side of said injection port, such that said injection port communicates with said first compression chamber, said wrap then moving over and blocking said injection port, and then moving past said injection port such that said injection port now communicates with said second compression chamber.

* * * * *